US010254087B2

(12) United States Patent
Lee

(10) Patent No.: US 10,254,087 B2
(45) Date of Patent: Apr. 9, 2019

(54) BULLETPROOF, SHOCK-ABSORBING HELMET

(71) Applicant: Jung-won Lee, Seoul (KR)

(72) Inventor: Jung-won Lee, Seoul (KR)

( * ) Notice: Subject to any disclaimer, the term of this patent is extended or adjusted under 35 U.S.C. 154(b) by 408 days.

(21) Appl. No.: 14/906,998

(22) PCT Filed: Jul. 23, 2014

(86) PCT No.: PCT/KR2014/006681
§ 371 (c)(1),
(2) Date: Jan. 22, 2016

(87) PCT Pub. No.: WO2015/012583
PCT Pub. Date: Jan. 29, 2015

(65) Prior Publication Data

US 2016/0161222 A1 Jun. 9, 2016

(30) Foreign Application Priority Data

Jul. 24, 2013 (KR) ..... 10-2013-0087435
Jun. 26, 2014 (KR) ..... 10-2014-0078764

(51) Int. Cl.
*A42B 3/06* (2006.01)
*A42B 3/14* (2006.01)
*A42B 3/28* (2006.01)
*F41H 1/04* (2006.01)

(52) U.S. Cl.
CPC ..... *F41H 1/04* (2013.01); *A42B 3/064* (2013.01); *A42B 3/065* (2013.01); *A42B 3/14* (2013.01); *A42B 3/283* (2013.01)

(58) Field of Classification Search
CPC ..... A42B 3/064; A42B 3/065; F41H 1/04
USPC ..... 2/6.6, 6.8, 416
See application file for complete search history.

(56) References Cited

U.S. PATENT DOCUMENTS 1,251,537 A * 1/1918 Kempny ..... A42B 3/0473 2/411
3,599,239 A * 8/1971 Tatum ..... A42B 3/06 2/416
2004/0168246 A1* 9/2004 Phillips ..... A42B 3/064 2/411
2012/0198604 A1 8/2012 Weber et al.

FOREIGN PATENT DOCUMENTS

KR 10-2003-0010919 A 2/2003
KR 10-0443970 Y1 3/2009
KR 10-1046145 B1 7/2011

OTHER PUBLICATIONS

International Search Report for PCT/KR2014/006681 dated Nov. 18, 2014.

* cited by examiner

*Primary Examiner* — Katherine M Moran
(74) *Attorney, Agent, or Firm* — STIP Law Group, LLC

(57) ABSTRACT

The present invention relates to a bulletproof, shock-absorbing helmet and, particularly, to a bulletproof, shock-absorbing helmet having undulations formed in a surface of an outer helmet so that incoming shells are deflected by sloped surfaces of the undulations, and having shock absorbing means provided in a space between the outer helmet and an inner helmet to absorb shocks and prevent injury due to shocks that would otherwise be transmitted to a head and a neck of a wearer when the shells are deflected.

18 Claims, 8 Drawing Sheets

BULLETPROOF, SHOCK-ABSORBING HELMET

CROSS-REFERENCE TO RELATED APPLICATIONS

This application is the U.S. National Phase under 35 U.S.C. § 371 of International Application No. PCT/KR2014/006681 filed on Jul. 23, 2014, which in turn claims the benefit of Korean Application No. 10-2013-0087435, filed on Jul. 24, 2013, and Korean Application No. 10-2014-0078764, filed on Jun. 26, 2014, the disclosures of which are incorporated by reference into the present application.

TECHNICAL FIELD

The present invention relates to a bulletproof, shock-absorbing helmet and, more particularly, to a bulletproof, shock-absorbing helmet having undulations formed in the surface of an outer helmet so that incoming shells are deflected by the sloped surfaces of the undulations, and also having shock absorbing means provided in a space between the outer helmet and an inner helmet to absorb shocks and prevent injury due to shocks that would otherwise be transmitted to the head and neck regions of the wearer when shells are deflected.

BACKGROUND ART

In general, a bulletproof helmet refers to a helmet that deflects a shell flying from the outside.

In our country, a steel helmet has been used as a military bulletproof helmet since the Korean War. Like another bulletproof helmet, the steel helmet is a helmet which is made of steel and is produced so as not to allow a shell of a small arm, fragments of a bomb or a cannonball or fragments of a rock to penetrate the helmet. The shape and material of the steel helmet are different in countries, but most steel helmets have a weight of about 1 kg. In order to increase the strength of the helmet cover, the steel helmet has been made of a steel material such as a special alloy including nickel, manganese, chromium, and silicon.

In recent years, the steel helmet has been replaced with a nylon helmet due to the weight and performance. The nylon helmet has been developed in 1974, and has been gradually supplied to the Korean military. Such a nylon helmet was used in the early 2000's. The nylon helmet has been used in partial rearguard units up to now in 2010, and as the bulletproof ability of the nylon helmet is doubted, a new model helmet has been strategized in the second half of 2003, as a self-develop business.

In order to increase the survivability of the Korean military, the new model helmet of the Korean military improves the bulletproof performance by 2.2 times (900→2,000 ft/sec) greater than that of the existing helmet. The helmet which is used in the advanced countries and has a bulletproof performance of 2,000 ft/sec has a weight of 1,300 g or more, whereas the new model helmet has been known as the lightest helmet having a weight of 1,150 g.

A depending ability of the M1 steel helmet called the Korean military bulletproof helmet merely defends fragments, and does not defend the shell. The M1 steel helmet does not defend even one 9-mm parabellum shell. Meanwhile, a Fritz helmet (US army) defends four shells without any defect.

The purpose of the bulletproof is to bounce the shell of the enemy in the actual situation (a distance of about 200 M).

However, when the shell is directly shot at the currently used bulletproof helmet, the shell penetrates the helmet within an effective shooting distance even through the pistol or the rifle is used.

In the most recent year, a bulletproof helmet produced by a method in which a light, strong aramid-fiber fabric is mixed with an adhesive and the mixture is press-molded with high heat has been introduced, and since the produced helmet is lighter and stronger than the steel, this helmet has been widely used. However, since this helmet has a semi-circular shape, there is a problem that the helmet is highly penetrated by the shell as it goes toward the upper end from the curved upper end of the bulletproof helmet.

Even though this helmet defends the shell, there are dangers of brain damages and serious neck injuries due to the shock.

Thus, it is necessary to achieve the safe of a wearer by increasing the thickness of the bulletproof helmet to increase the bulletproof performance. However, in this case, since the weight of the bulletproof helmet is increased, the herniated cervical disc of the wearer may be caused, and the combat capability thereof may be degraded.

In order to solve the problems, a bulletproof helmet made of an aramid fiber having light weight and excellent bulletproof performance is recently introduced. Such an aramid fiber is not sufficient as a composite material for bulletproof requiring excellent light properties due to its high specific gravity of about 1.44. A composite material for bulletproof manufactured using an aramid fabric impregnated with a typical resin such as a phenol resin has a problem that the bulletproof performance is degraded since the adhesive strength is degraded between the aramid fabrics.

For reference, as the documents regarding the related arts regarding the bulletproof helmet, for example, there are Korean Patent Publication No. 10-2011-0070118 (Application date: Dec. 18, 2009; ANTI-BALLISTIC PROTECTIVE COMPOSITE AND ANTI-BALLISTIC PROTECTIVE HELMET MANUFACTURED BY USING THE SAME) and Korean Utility Model Registration No. 0392560 (Application data: May 13, 2005; PROTECTIVE HELMET).

There are not currently bulletproof helmets having the defending ability capable of perfectly depending the direct shooting of the rifle shell including the technologies of the above-described documents.

Accordingly, there is a need for development of a bulletproof helmet capable of preventing the bulletproof helmet from being penetrated to relieve the shock by accurately deflecting the entering shell while minimizing the weight by producing the thickness of the helmet.

DISCLOSURE

Technical Problem

The present invention has been made in order to solve the problems of the already registered related art and to satisfy the requirements, and an object of the present invention is to provide a bulletproof, shock-absorbing helmet capable of protecting the head and neck of the wearer from the shock by forming the undulations on the surface of the bulletproof helmet that deflects the entering shell or the general bulletproof helmet as a round curved surface to deflect the entering shell from the sloped surface of the undulation and forming the inner space in the bulletproof helmet to relieve the shock generated by the impact of the shell with the helmet.

Technical Solution

In order to achieve the above object, according to the present invention, reflecting undulations (11) are formed on an outer surface of an outer helmet (10) so as to minimize an area in which a shell enters at a right angle and to maximize an area in which the shell is deflected.

A buffer space is formed between the outer helmet and the inner helmet provided within the outer helmet, and a plurality of first shock absorbing means are formed in the circumferences of the inner and outer helmets so as to absorb the external shock of the shell and second shock absorbing means is formed at the top. An additional member is provided on an inner surface of the inner helmet, as third shock absorbing means, to protect the head and neck of the wearer while gradually absorbing the shock applied from the outside.

Effect of the Invention

In the present invention according to the above-described technical solutions, the sloped undulations are formed on the outer helmet, and the area in which the shell enters at the right angle is minimized and the area in which the shell is deflected is maximized. Thus, an effect of increasing the bulletproof performance with respect to the entering shell while minimizing a probability that the shell will enter at the right angle is obtained.

The buffer space is secured between the outer helmet and the inner helmet, and the first and second shock absorbing means are provided. Thus, when the shock is applied to the outer helmet, the outer helmet is moved while narrowing the buffer space with the second shock absorbing means its center. In this case, the biggest effect capable of minimizing the shock transferred to the inner helmet to prevent the head and neck of the wearer from being injured by preventing the buffer space from being narrow using the shock absorbing spring of the first and second shock absorbing means to absorb the shock is obtained.

The outer helmet and the inner helmet are not directly in contact with each other by the buffer space, and thus, an effect of relieving instantaneous shock due to the operation of the first and second shock absorbing means while preventing the shock of the shell from being directly transferred to the wearer.

Meanwhile, the sloped undulations are formed on the outer surface of the outer helmet, and thus, the shell can enter from the front, rear or lateral side thereof at an angle of 45° or less. As a result, an effect of dispersing the penetrating shock of the shell toward the top, bottom and front sides and weakening the shock is obtained.

The area in which the shell enters at the right angle is minimized, and the area in which the shell is deflected is maximized. Thus, an effect of increasing the bulletproof performance with respect to the entering shell while minimizing the probability that the shell will enter the outer helmet at the right angle is obtained.

An effect of increasing the protecting ability of the helmet by reducing the penetrating probability while relieving the shock by the deflecting the entering shell.

An effect of increasing the thickness of the sloped reflecting undulation with respect to the direction in which the shell enters without increasing the actual thickness of the outer helmet is obtained, and thus, an effect of remarkably reducing the penetrating probability of the shell is obtained.

The protrusions having small mountain shapes are formed in the valleys of the reflecting undulations, and are formed so as to have the thickness greater than the thickness of another portion of the outer helmet. Thus, an effect of preventing the shell from penetrating the outer helmet even when the shell accurately enters the valleys of the reflecting undulations is obtained.

BEST MODE

The present invention will be described below with reference to the accompanying drawings.

Figure 1:
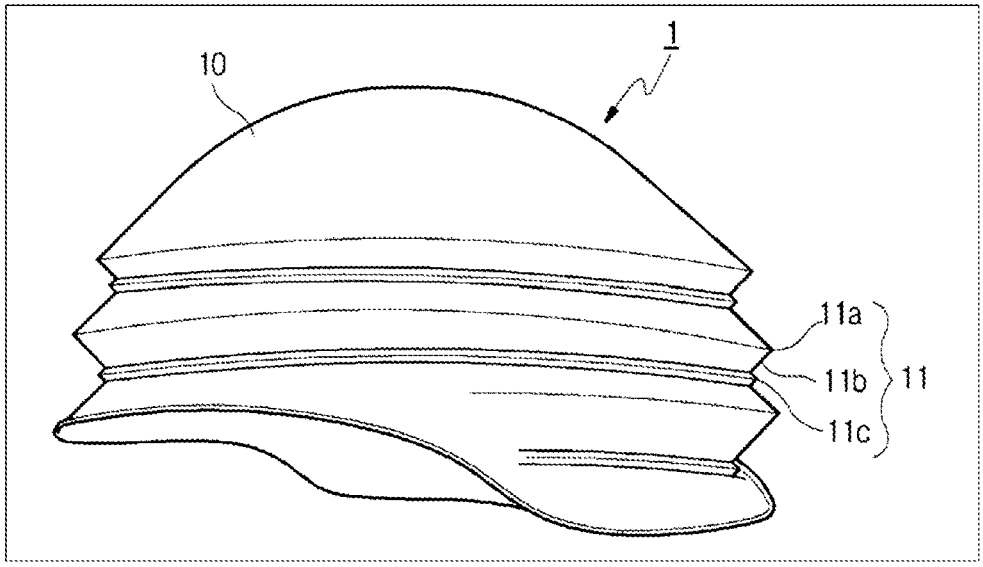
FIG. 1 is a perspective view showing a bulletproof helmet on which reflecting undulations are formed according to the present invention.

As shown in FIG. 1, a bulletproof helmet 1 includes an outer helmet 10 on which reflecting undulations 11 are formed in an outer surface so as to deflect incoming shells.

As shown in FIGS. 2 to 5, the bulletproof helmet mainly includes an inner helmet 20 disposed while securing a buffer space 30 at a predetermined distance within the outer helmet 10 on which the reflecting undulations 11 are formed, and first shock absorbing means 40*a* and 40*b* and second shock absorbing means 50 which are provide in the buffer space 30 to absorb the shock applied to the outer helmet 10. The bulletproof helmet further includes third shock absorbing means 70 that absorbs the shock within the inner helmet 20 to minimize the shock.

Figure 2:
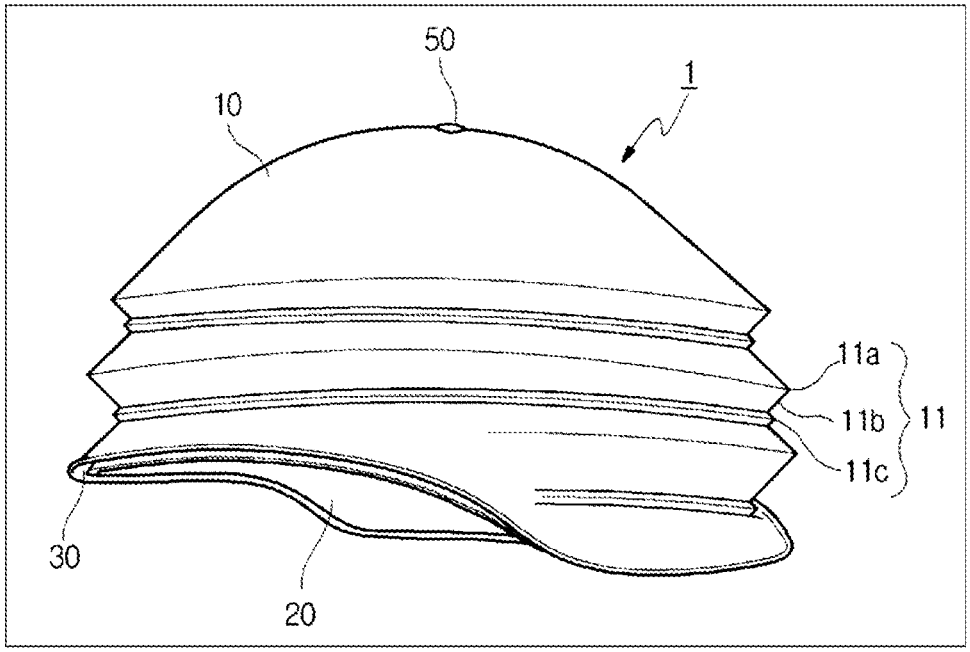
FIG. 2 is a perspective view showing the bulletproof helmet provided with shock absorbing means according to the present invention.
Figure 6:
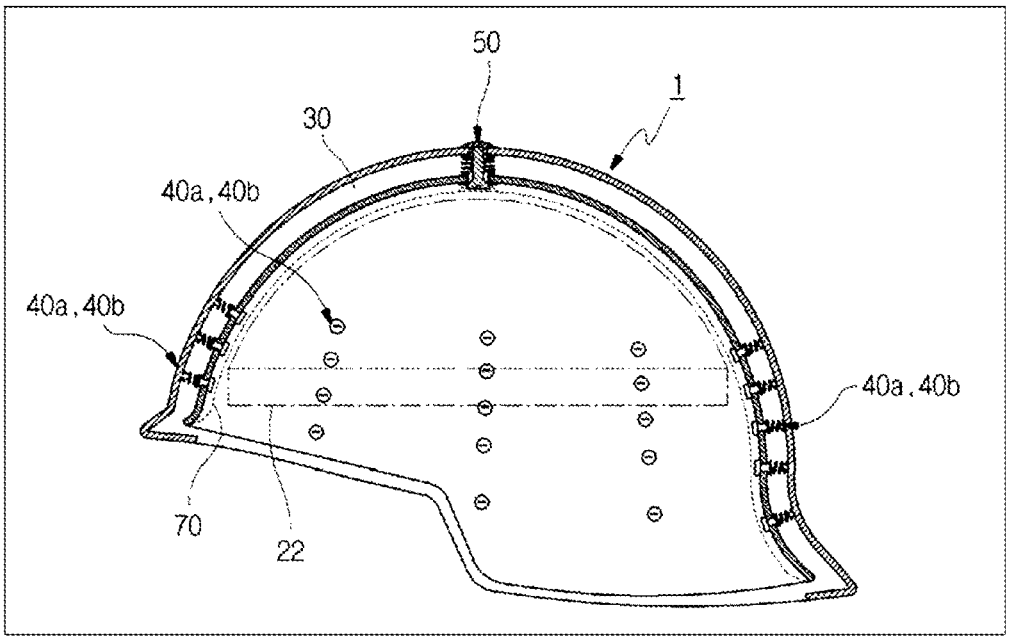
FIG. 6 is a side sectional view showing a bulletproof helmet on which reflecting undulations are not formed on an outer helmet according to the present invention.

The reflecting undulations 11 having sloped angles may be formed in the outer surface of the outer helmet 10 as shown in FIGS. 1 and 2, or only a curved surface that does not have the reflecting undulations may be formed on the general outer helmet 10 as shown in FIG. 6. Specifically, the bulletproof, shock-absorbing helmet may be formed in various shapes such as a typical military helmet shape or a safety helmet shape worn in the workplace.

Figure 4:
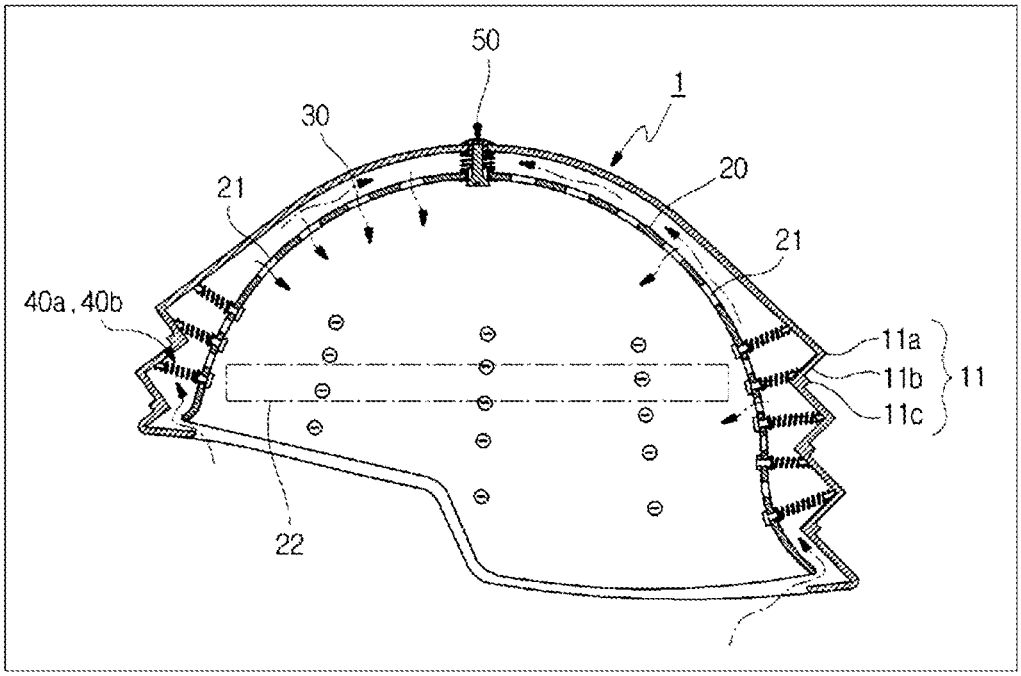
FIG. 4 is a side sectional view showing a case where vent holes are formed in an inner helmet in FIG. 3.
Figure 5:
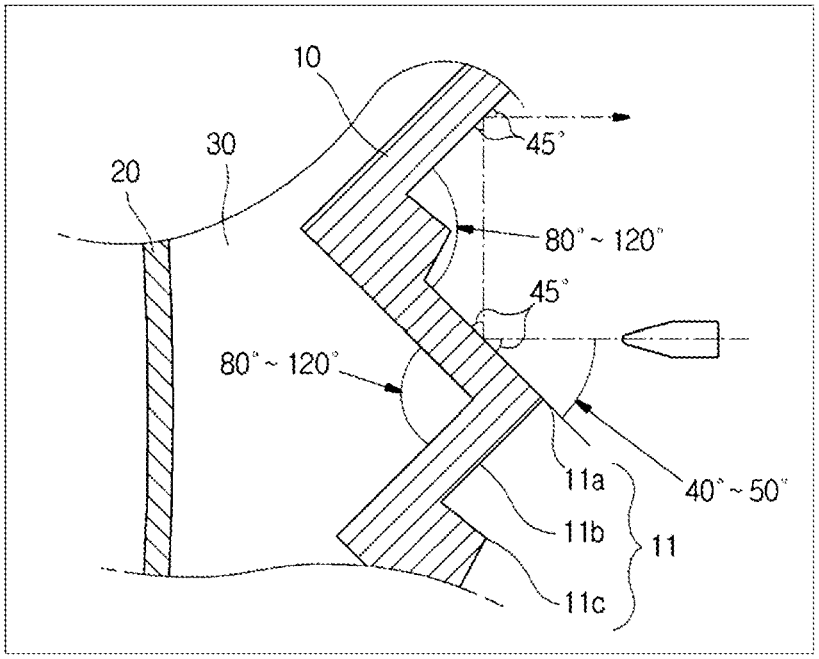
FIG. 5 is a partial enlarged sectional view showing an angle of the reflecting undulation according to the present invention.

As shown in FIGS. 1, 2 and 4, the reflecting undulations 11 formed on the outer helmet 10 are used to minimize an area in which the shells enter at a right angle and to maximize an area in which the shells are deflected. The undulations of which sectional shapes are triangular shapes are continuously formed as mountains 11*a* and valleys 11*b* which respectively have angles of 80° and −120°, and the reflecting undulations 11 formed in this manner are arranged in the outer helmet 10 in a horizontal direction (a transversal direction).

An angle formed by the shell horizontally entering from the front, rear or lateral side of the outer helmet 10 and the surface of the reflecting undulation 11 is 40° to 50°, and thus, the shell is suitably deflected without penetrating the reflecting undulations 11. A preferred angle formed by the entering shell and the surface of the reflecting undulation 11 is 45°, and thus, the bulletproof performance is most suitably increased.

Meanwhile, reflecting protrusions 11*c* are formed at the valleys 11*b* of the reflecting undulations, and the strength of the valleys 11*b* of the defecting undulations 11 that are vulnerable to the direct shock of the shell is reinforced. Thus, the reflecting protrusions can relieve the shock applied to the upper part or the lower part of the helmet by secondarily reflecting the shell which has primarily entered and has reflected from the sloped portions of the reflecting undulations 11. The shape of the reflecting protrusion 11*c* may be a triangular shape shown in the drawing, and the preferred shape thereof may be a semi-circular shape or a curved shape.

When the reflecting undulations 11 are formed on the outer helmet 10 in a strip shape in the horizontal direction, the reflecting undulations may be formed on the entire outer helmet 10. However, in the embodiment of the present invention, the reflecting undulations are formed up to two thirds of a portion extending upward from a lower edge, and in this case, the number of undulations of the reflecting undulations is limited to 2 to 6. However, the number of undulations may be increased or decreased depending on the size of the outer helmet 10.

The outer surface of the outer helmet 10 may be covered with fabric cover that is used in camouflage at the time of the military operation.

When the shell enters the outer helmet 10 having the above-described configuration, the reflecting undulations 11 deflect the shell, and thus, the shock is relieved by preventing the shell from penetrating the outer helmet 10. The thickness of the section of reflecting undulation where the shell enters is increased in a straight line, and thus, the shell is bounced against the sloped reflecting undulations 11 without penetrating the reflecting undulations.

More specifically, when the shell enters a lower sloped surface, the shell is deflected depending on the angle of the surface, and when the shell enters an upper sloped surface of the reflecting undulation 11, the shell is deflected upward depending on the entering angle. When the shell enters a lower sloped surface of the reflecting undulation 11, the shell is deflected downward depending on the entering angle, and when the shell enters an upper curved surface of the outer helmet 10 other than the reflecting undulation 11, the shell is bounced against the curved surface and is deflected upward depending on the entering angle. In general, most kinetic energy of the shell is converted to impact energy at a nearly right angle, and the converted energy acts on a subject.

However, the bulletproof helmet 1 has an entering angle of 45° or less, and the shell can be deflected. Thus, the shock is applied in a short moment (about one second in thirty thousands) without lasting for a while and disappears. Accordingly, the shock due to shooting can be minimized.

The sloped portion of the defecting undulation 11 may be formed in straight line shape, but may be curved in a recess shape or a protrusion shape.

Figure 3:
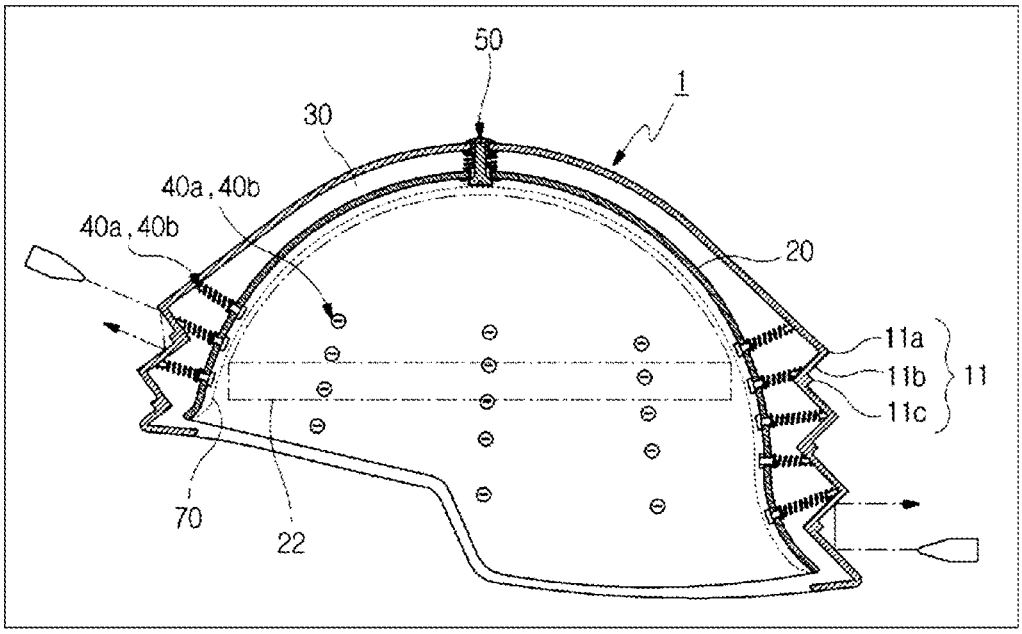
FIG. 3 is a side sectional view of FIG. 2.

As shown in FIGS. 3 and 4, a plurality of vent holes 21 is formed in the inner helmet 20 so as to ventilate external air, and cool external air introduced into the buffer space 30 is transmitted to the head through the vent holes 21, and the heat of the head is cooled. The material of the inner helmet can be saved due to the formation of the vent holes 21, and the bulletproof helmet 1 can be manufactured in a light weight.

Since a wearing bezel 22 for allowing a wearer to wear the helmet so as to match with the head size of the wearer is formed in the inner helmet 20 with a distance from the inner helmet 20, the shock absorbing means do not interfere with the header of the wearer even though the first and second shock absorbing means 40*a*, 40*b* and 50 protrude toward the inside of the inner helmet 20.

The third shock absorbing means 70 that protects the head of the wearer may be provided in the inner surface of the inner helmet 20, and the third shock absorbing means 70 may be attached to the entire inner surface, or a plurality of shock absorbing pads manufactured as a single block having a suitable size may be attached.

Meanwhile, the first shock absorbing means 40*a* and 40*b* and the second shock absorbing means 50 absorb the shock of the outer helmet 10 such that the shock applied to the outer helmet due to the entering of the shell is not transmitted to the wearer while securing the buffer space 30, and two embodiments of the first shock absorbing means 40*a* and 40*b* of the present invention are provided.

Figure 7:
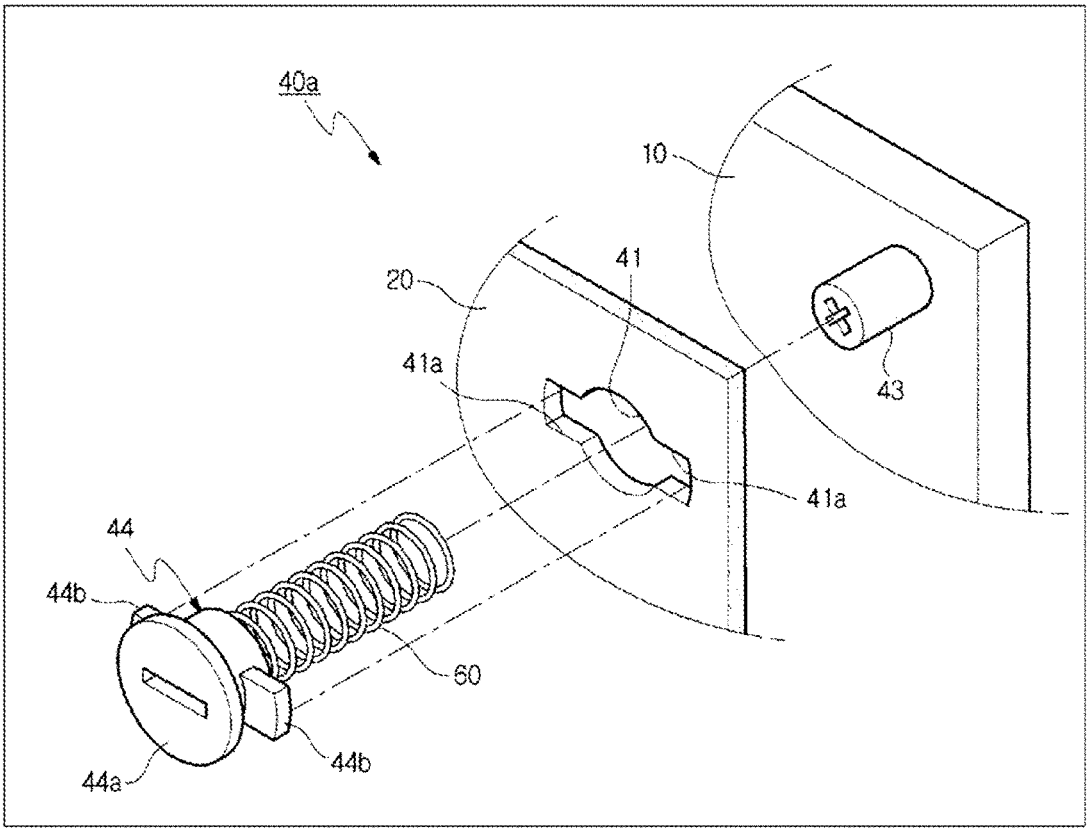
FIG. 7 is an exploded perspective view showing the extract of first shock absorbing means (40*a*) according to the present invention.
Figure 8:
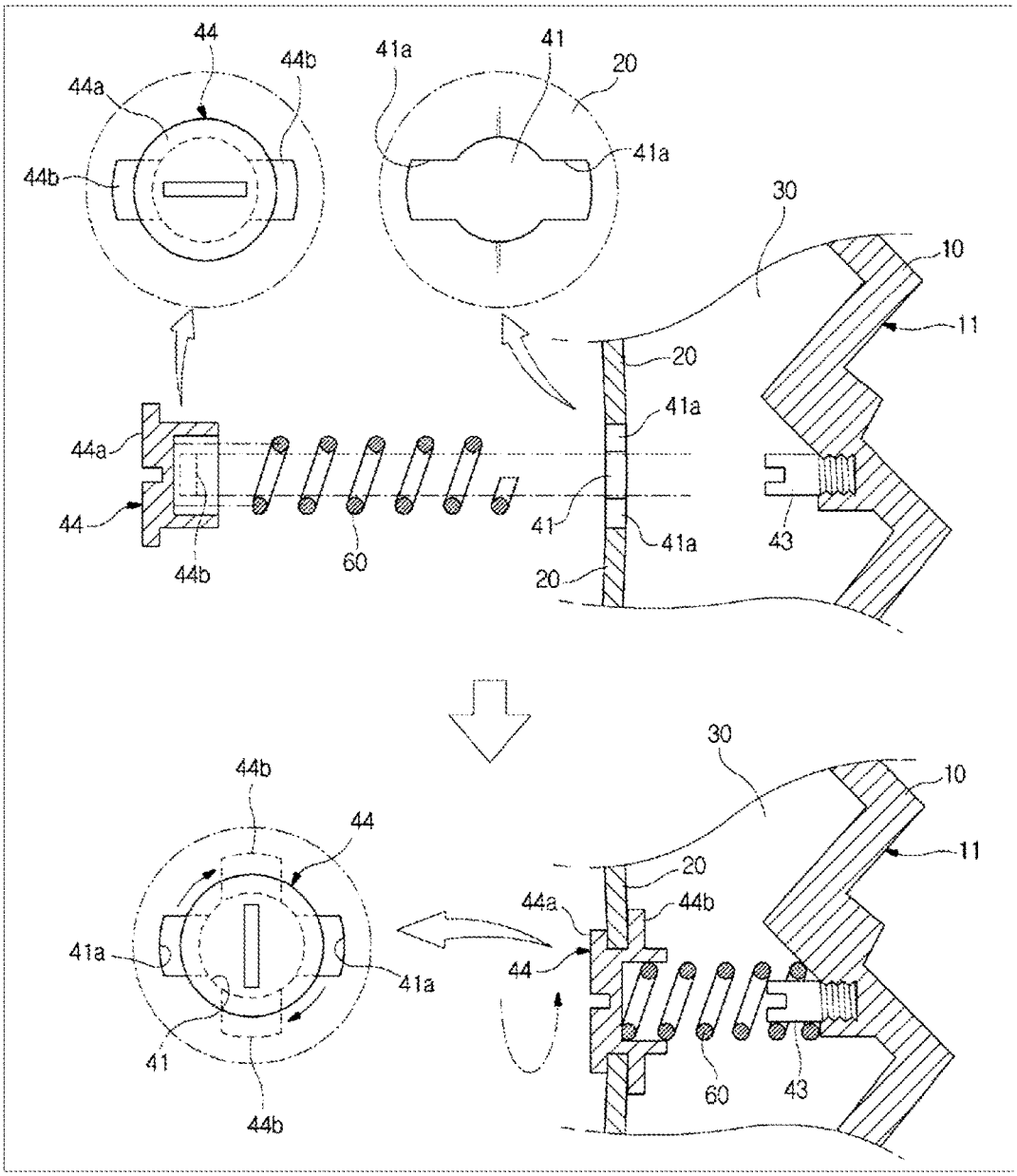
FIG. 8 is a side sectional view showing a state in which the first shock absorbing means coupled in FIG. 7 is operated.

Firstly, as shown in FIGS. 7 and 8, the first shock absorbing means 40*a* includes an attachment hole 41*a* which penetrates the inner helmet 20 and has a circular shape, and an insertion portion 41*a* formed in one side or both sides of the attachment hole 41 so as to have a width smaller than a diameter of the circular shape.

A spring fixing protrusion 43 is coupled to and is fixed to the inner surface of the outer helmet 10 corresponding to the attachment hole 41.

A spring holder 44 inserted into the attachment hole 41 includes a head 44*a* formed at one end so as to be greater than the diameter of the attachment hole 41, and engagement portions 44*b* having the same shape capable of penetrating the insertion portion 41*a* in a position separated from the head 44*a* by a thickness of the inner helmet 20. An installation groove is formed in the other surface of the spring holder 44. One end of a shock absorbing spring 60 that provides the shock absorbing performance is inserted to and is fixed to the installation groove, and the other end is in contact with the inner surface of the outer helmet 10 in a state in which the spring fixing protrusion 43 is inserted into and is fixed. The shock absorbing spring is supported and also absorbs the shock.

The assembling procedure of the first shock absorbing means 40*a* having the above-described configuration will be described. Initially, the shock absorbing spring 60 is inserted to and is fixed to the other end of the spring holder 44, and when the engagement portion 44*b* is inserted into the insertion portion 41*a*, the inner surface of the outer helmet 10 is supported by the shock absorbing spring 60 while the spring fixing protrusion 43 is inserted to the other end of the shock absorbing spring 60. Subsequently, the engagement portion 44*b* of the spring holder 45 is rotated by 90° so as to be separated from the insertion portion 41*a*, and the thickness of the inner helmet 20 engages and is fixed between the head 44*a* and the engagement portion 44*b*.

Here, a groove or a protrusion is preferable formed on the outer surface of the head 44*a* such that an operator can rotate the head by using a tool or directly with the hand.

The first shock absorbing means 40*a* can absorb the shock applied to the outer helmet from the top, bottom and side by using the shock absorbing spring 60 fixed such that the both ends are not arbitrarily separated.

Figure 9:
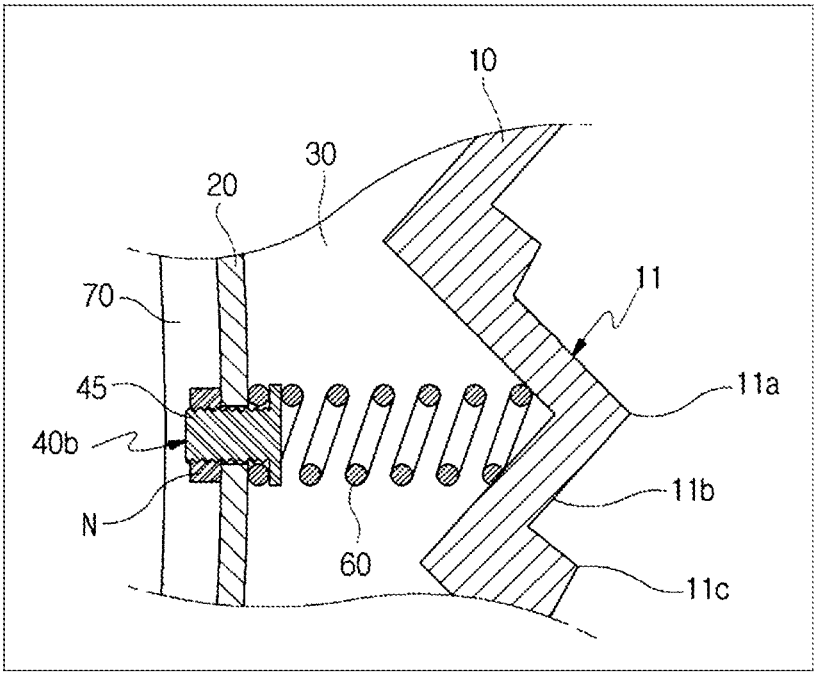
FIG. 9 is a side sectional view showing the extract of another first shock absorbing means (40*b*) of the present invention.
Figure 10:
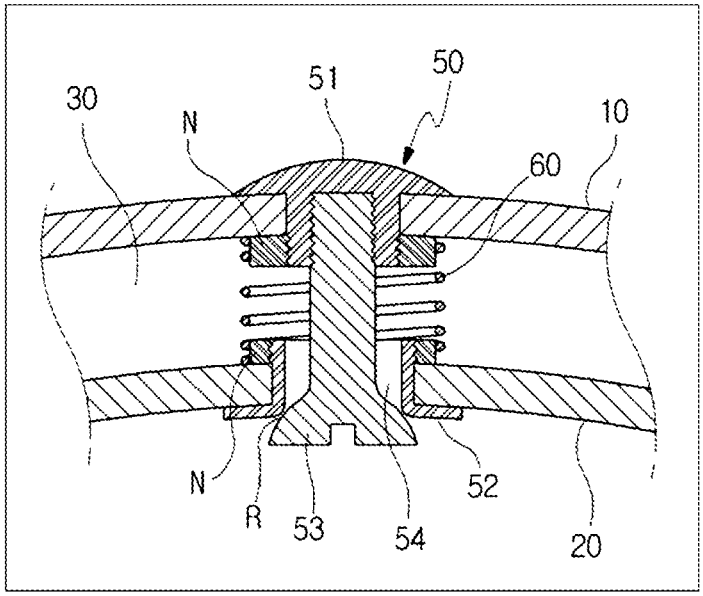
FIG. 10 is a side sectional view showing the extract of second shock absorbing means according to the present invention.

Secondly, as shown in FIG. 9, the first shock absorbing means 40*b* is configured in such a manner that a penetrating hole is formed in the inner helmet 20, the one end of the spring holder is fastened and fixed within the inner helmet 20 through a nut N by inserting the one end of the spring holder 45 provided with a screw thread at the outer periphery into the penetrating hole, and the other end of the shock absorbing spring 60 is supported while being in contact with the inner surface of the outer helmet 10 by inserting and fixing the one end of the shock absorbing spring 60 into and to the other end of the spring holder 45 having a relatively large diameter. With such a configuration, the shock absorbing spring 60 that supports the shock absorbing means while maintaining the space of the buffer space 30 is simply assembled.

Meanwhile, as shown in FIG. 9, the second shock absorbing means 50 is freely rotated in all directions in such a manner that a penetrating hole is formed in the top of the outer helmet 10, a rotational shaft coupling member 51 which is inserted into the penetrating hole and is provided with screw threads in the inner and outer peripheries of is fastened through a nut N, the rotational shaft coupling member is fastened to the outer periphery through a nut N by being inserted into the penetrating hole formed in the inner helmet 20 corresponding to the rotational shaft coupling member 51 by providing a space securing member 52 formed so as to have an inner diameter greater than the inner diameter of the rotational shaft coupling member 51, the shock absorbing spring 60 of which the upper and lower ends are respectively fixed to the nuts N fastened to the rotational shaft coupling member 51 and the space securing member 52 is provided to provide the shock absorbing performance, a rotation space 54 is secured by forming a column of a rotational shaft 53 of which the upper end is fastened to the inner periphery of the rotational shaft coupling member 51 to be smaller than the diameter of the space securing member 52, and the upper surface of the lower end is guided while the curved surface R of the upper surface engages with the lower end of the space securing member 52 by forming the upper surface of the lower end as a curved surface R.

The second shock absorbing means 50 having the above-described configuration serves to initially fix the outer helmet 10 to the inner helmet 20, relieves the shock in cooperation with the first shock absorbing means 40*a* and 40*b* while the rotational shaft 53 is rotated in a direction opposite to the direction in which the shock is applied from the side, and absorbs the shock applied from the top while compressing the shock absorbing spring 60.

Here, as a preferred size for securing the rotation space 54 of the second shock absorbing means 50, the space securing member 52 has an inner diameter greater than the diameter of the column of the rotational shaft 53 by 5 mm to 10 mm.

Figure 11:
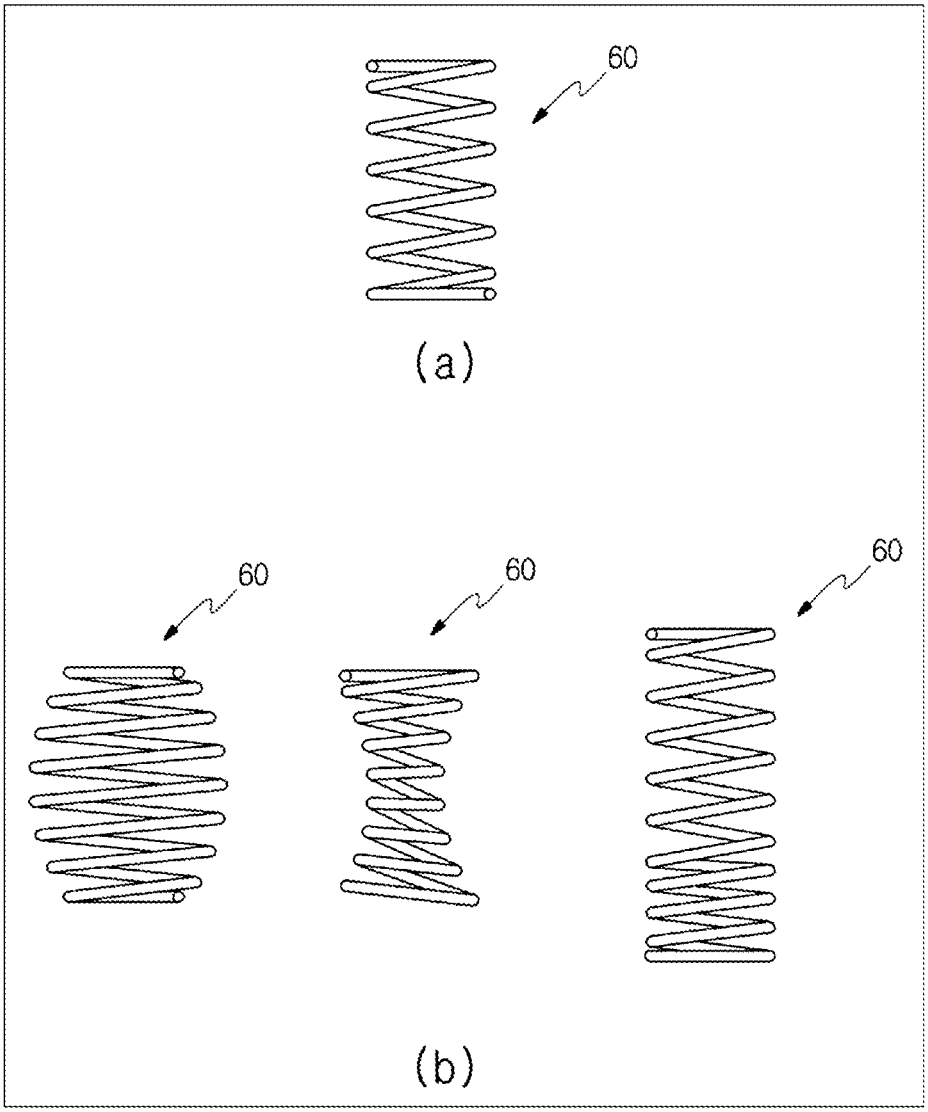
FIG. 11 is a side sectional view showing linear (a) and non-linear (b) shock absorbing springs according to the present invention.

As shown in FIG. 11, the shock absorbing spring 60 that absorbs the shock in the first shock absorbing means 40*a* and 40*b* and the second shock absorbing means 50 may be a linear spring in which a pitch or an outer diameter of a coil is generally constant depending on the deformation of the hardness, or a non-linear spring in which a pitch or an outer diameter of a coil is different depending on the deformation of the hardness. When the non-linear spring is used, the shape thereof may be a convex shape of which the outer diameter of the central portion of the is large, a double-headed drum shape with a narrow waist in the middle of which the central portion is concave, or a shape of which a pitch of one end is narrow and a pitch of the other end is wide.

The shock absorbing spring 60 is formed to have a length greater than the length of a side section of the buffer space 30, and thus, the shock absorbing spring 60 is provided in a compressed state at the time of assembling the first shock absorbing means 40*a* and 40*b* and the second shock absorbing means 50.

When the shock is applied to the outer helmet 10, the compressed shock absorbing spring 60 is moved while reducing the buffer space 30 in the movement direction, and in this case, the shock absorbing spring can continuously support the inner surface of the outer helmet 10 even though the compressed shock absorbing spring 60 is stretched.

Here, a material capable of absorbing the shock other than the shock absorbing spring 60 serving to absorb the shock in the first and second shock absorbing means 40*a*, 40*b* and 50 may be formed in a spring shape or a circular shape, and may be made of, for example, rubber, urethane, or silicon.

Meanwhile, the outer helmet 10 and the inner helmet 20 may be made of metal, synthetic resin, or polymeric fiber (for example, high molecular weight polyethylene (HMPE), or aramid fiber).

In the embodiment of the present invention, the outer and inner helmets made of aramid fiber are used.

The aramid fiber is an aromatic polyamide fiber, and has a very strong and straight molecular structure. A fiber having high orientation and high strength is obtained without elongation by simply emitting an undiluted chemical. This fiber is used to produce a bulletproof vest due to its high bulletproof performance, and when this fiber is used as a plastic reinforcing agent, a rocket engine case can be reinforced using this fiber, and this fiber has excellent tensile force and heat resistance as industrial fiber.

The aramid fiber, that is, a wholly aromatic polyamide fiber includes a para-aramid fiber having a structure in which benzene rings are straightly connected through amidogen (—CONH) and a meta-aramid fiber not having such a structure. The para-aramid fiber has excellent characteristics such as high strength, high elasticity, and low contraction, and has a high strength capable of raising a two-ton vehicle only using a thin thread having a thickness of about 5 mm. Thus, the para-aramid fiber has been widely used as a composite material for bulletproof.

The composite material for bulletproof using such an aramid fiber is typically produced by producing aramid fabrics using the aramid fiber, impregnating the aramid fabric with polymer resin to produce semi-cured aramid fabrics, layering the semi-cured aramid fabrics in a mold in multiple layers, and curing the layered aramid fabrics.

The shocks of shells of the AK47 rifle and the K2 rifle and a baseball with respect to the bulletproof helmet 1 having such a configuration are compared, and are shown in Table 1.

TABLE 1

| Classification | AK 47 | K2 | Baseball (150 km) | note |
|---|---|---|---|---|
| shell speed m/sec | 700 | 910 | 41.7 | |
| Weight | 7.95 g | 3.6 g | 142 g | |
| Impact energy kg/10 m/sec | 19.4775 | 14.90 | 1.233 | AK: 16 times baseball<br>K2: 12 times baseball |
| Intensity comparison of shock | 16 | 12 | 1 | |
| Shock applied to bulletproof helmet at 45° | →4.8686 kg/ 10 m/sec | →3.7265 kg/ 10 m/sec | | AK: 3.95 times baseball<br>K2: 3.0 times baseball |
| →25%, ↗ 50%, ↑↓25% | | | | |
| Estimation of final shock in a case where shock-absorbing helmet is included (helmet: 1.1 kg, spring strength: 1.8 kg | →1.97 kg/ 10 m/sec | →0.873 kg/ 10 m/sec | | AK: 1.60 times baseball<br>K2: 0.71 times baseball |

Analysis 1. The bulletproof and shock absorbing performance is required (there are dangers of serious neck and head injuries since shock intensity is 16 times greater than that of the baseball having a speed of 150 km).
Analysis 2. The shock is reduced by 75% due to bulletproof of 45°, and shock is 4 times greater than that of the baseball (there are dangers of serious neck and head injuries).
Analysis 3. There is an effect of relieving the shock by 60% or more in a case where the shock absorbing helmet is included (the shock intensity is 1.6 times greater than that of the baseball, the remaining shock is absorbed by an additional member, and the shock is relieved up to the shock level of the baseball.

$E = \frac{1}{2} mv_2$, 100→25, ↗ 50, ↑↓25 in a case where the shell is shot at 45°, wherein → (shock of helmet in a case where shell horizontally enters), ↗ (deflecting shock of helmet), ↑↓ (upper and lower shocks of helmet).

The operation state of the bulletproof helmet 1 of the present invention having the above-described configuration will be described below.

Firstly, when the shell enters, the shell is deflected without penetrating the helmet due to the reflecting undulations 11 formed on the outer helmet 10, and thus, a wearer's precious life can be protected.

Alternatively, the entered shell is deflected due to the reflecting undulations 11 formed on the outer helmet 10, and the external shock generated by the shell is relieved by reducing the space of the buffer space 30 in the direction in which the shell enters by the outer helmet 10 with the rotational shaft 53 connected to the inner helmet 20 fixed to the head of the wearer as its center and compressing the shock absorbing spring 60 provided in the first and second shock absorbing means 40*a*, 40*b* and 50. The third shock absorbing means 70 provided on the inner surface of the inner helmet absorbs the remaining shock, and thus, it is possible to prevent the head and neck of the wearer from being injured.

Accordingly, the shock generated in the outer helmet 10 is not directly transferred to the inner helmet 20, and is relieved by the first, second and third shock absorbing means 40*a*, 40*b*, 50 and 70 provided in the buffer space 30. Thus, the wearer can be safely protected by preventing the head and neck of the wearer from being injured, and it is possible to provide the useful bulletproof helmet 1 capable of previously preventing the mobility required in the modern battle from being decreased.

Although the present invention has been described and illustrated in conjunction with the preferred embodiment for exemplifying the principle of the present invention, but the present invention is not limited to the configuration and effect described and illustrated above.

It should be understood to those skilled in the art that the present invention can be modified and changed in various manners without departing from the spirit and scope of the claims.

Therefore, all appropriate changes, modifications and their equivalents are intended to fall within the scope of the present invention.

DESCRIPTION OF MAIN REFERENCE NUMERALS OF DRAWINGS

| | |
|---|---|
| Bulletproof helmet: 1 | Outer helmet: 10 |
| Reflecting undulation: 11 | Mountain: 11a |
| Valleys: 11b | Reflecting protrusion: 11c |
| Inner helmet: 20 | Vent hole: 21 |
| Wearing bezel; 22 | Buffer space: 30 |
| First shock absorbing means: 40a, 40b | Attachment hole: 41 |
| Insertion Portion: 41a | Spring fixing protrusion: 43 |
| Engagement portion: 44b | Second shock absorbing means: 50 |
| Rotational shaft coupling member: 51 | Space securing member: 52 |
| Rotational shaft: 53 | Rotation space: 54 |
| Curved surface: R | Nut: N |
| Shock absorbing spring: 60 | Third shock absorbing means: 70 |

The invention claimed is:

1. A bulletproof, shock-absorbing helmet comprising:

an outer helmet;

a reflecting undulation that is formed on an outer surface of the outer helmet so as to minimize an area in which a shell enters at a right angle and to maximize an area in which the shell is deflected, wherein the reflecting undulation includes valleys and mountains which have sloped angles of 80° to 120°; and reflecting protrusions protruding from the valleys.

2. The bulletproof, shock-absorbing helmet according to claim 1, wherein the reflecting undulation is formed in a strip shape in a horizontal direction with respect to the outer surface of the outer helmet, and when the shell enters the outer surface of the outer helmet, an angle formed by the shell and a surface of the reflecting undulation is 40° to 50°.

3. The bulletproof, shock-absorbing helmet according to claim 1, wherein the reflecting undulation is formed on the entire outer surface of the outer helmet, or is partially formed up to two thirds of a portion extending upward from an edge of a lower end, and includes 2 to 6 undulations.

4. The bulletproof, shock-absorbing helmet according to claim 1, further comprising, an inner helmet, wherein the outer helmet or the outer helmet and the inner helmet are made of a metal material, a synthetic resin material, or a polymer fiber.

5. A bulletproof, shock-absorbing helmet comprising:

an inner helmet;

an outer helmet;

a plurality of first shock-absorbing means that is provided in circumferences of the inner helmet and the outer helmet so as to relieve an external shock of a shell while maintaining a buffer space between the outer helmet and the inner helmet, wherein the outer helmet is adapted to bounces and deflects the shell and the inner helmet is provided within the outer helmet;

second shock absorbing means that is provided on an upper part of the inner helmet and the outer helmet and fix the outer helmet to the inner helmet; and third shock absorbing means that is formed on an inner surface of the inner helmet so as to protect a wearer head of a wearer.

6. The bulletproof, shock-absorbing helmet according to claim 5, wherein the first shock absorbing means includes:

an elongated attachment hole formed through the inner helmet, wherein the elongated attachment hole has a circular insertion portion so as to extend from one side or both sides of the first shock absorbing means with a prescribed width;

a spring fixing protrusion that is fixed to an inner surface of the outer helmet so as to correspond to the elongated attachment hole;

a spring holder that includes a head and engagement portions, wherein the spring holder is inserted into the elongated attachment hole, the head is formed to be greater than a diameter of the elongated attachment hole, and the engagement portions are formed in a position separated from the head by a thickness of the inner helmet, and have the same shape with the elongated attachment hole to pass through the circular insertion portion so as to be engaged with the inner helmet after rotating; and a shock absorbing spring that is fit to the other end of the spring holder to relieve the external shock while supporting the outer helmet and the inner helmet.

7. The bulletproof, shock-absorbing helmet according to claim 5, wherein the first shock absorbing means includes:

a spring holder that includes a penetrating hole formed in the inner helmet, and one end inserted into the penetrating hole and receiving a nut screwed and fastened thereto; and a shock absorbing spring that is fit to the other end of the spring holder to absorb the external shock while maintaining the outer helmet and the inner helmet.

8. The bulletproof, shock-absorbing helmet according to claim 5, wherein the second shock absorbing means includes:

a rotational shaft coupling member in which screw threads are formed in an outer periphery and an inner periphery, wherein the outer periphery of the rotational shaft coupling member receives a first nut screwed and fastened thereto so as to allow a top of the rotational shaft coupling member to be engaged on a top of the outer helmet through a penetrating hole of the outer helmet;

a space securing member in which an inner diameter is greater than an inner diameter of the rotational shaft coupling member, wherein an outer periphery of the space securing member receives a second nut screwed and fastened thereto so as to allow a bottom of the space securing member to be engaged to the inner helmet through a penetrating hole of the inner helmet corresponding to the rotational shaft coupling member;

a shock absorbing spring of which upper and lower ends are fixed to the first nut and the second nut, respectively; and a rotational shaft that is fastened to the inner periphery of the rotational shaft coupling member through a screw to secure a buffer space within the space securing member, and is rotatable while being engaged with a lower end of the space securing member by forming a top surface as a curved surface.

9. The bulletproof, shock-absorbing helmet according to claim 5, wherein a plurality of vent holes is formed in the inner helmet so as to ventilate external air introduced to or exhausted from the buffer space to the wearer head.

10. The bulletproof, shock-absorbing helmet according to claim 5, wherein the outer helmet or the outer helmet and the inner helmet are made of a metal material, a synthetic resin material, or a polymer fiber.

11. A bulletproof, shock-absorbing helmet comprising:

an inner helmet;

an outer helmet;

a reflecting undulation that is formed on an outer surface of the outer helmet so as to minimize an area in which a shell enters at a right angle and to maximize an area in which the shell is deflected, wherein the reflecting undulation has sloped angles;

a plurality of first shock-absorbing means that is provided in circumferences of the inner helmet and the outer helmet so as to relieve an external shock of the shell while maintaining a buffer space between the outer helmet and the inner helmet, wherein the outer helmet is adapted to bounces and deflects the shell and the inner helmet is provided within the outer helmet;

second shock absorbing means that is provided on an upper part of the inner helmet and the outer helmet and fix the outer helmet to the inner helmet; and third shock absorbing means that is formed on an inner surface of the inner helmet so as to protect a wearer head of a wearer.

12. The bulletproof, shock-absorbing helmet according to claim 11, wherein the reflecting undulation comprises multiple undulations, each undulation is formed in a strip shape in a horizontal direction with respect to the outer surface of the outer helmet, and has a mountain and a valley, an angle formed by the mountain and the valley is 80° to 120°, and when the shell enters an outer surface of the each undulation, an angle formed by the shell and the outer surface of the each undulation is 40° to 50°.

13. The bulletproof, shock-absorbing helmet according to claim 11, wherein the reflecting undulation comprises multiple undulations and each undulation has a mountain and a valley, and a reflecting protrusions is further formed in the valley of each undulation.

14. The bulletproof, shock-absorbing helmet according to claim 11, wherein the reflecting undulation is formed on the entire outer surface of the outer helmet, or is partially formed up to two thirds of a portion extending upward from an edge of a lower end, and includes 2 to 6 undulations.

15. The bulletproof, shock-absorbing helmet according to claim 11, wherein the first shock absorbing means includes:

an elongated attachment hole that is formed to penetrate the inner helmet, and is provided with a circular insertion portion so as to extend from one side or both sides of the first shock absorbing means with a prescribed width;

a spring fixing protrusion that is fixed to an inner surface of the outer helmet so as to correspond to the elongated attachment hole;

a spring holder that includes a head and engagement portions, wherein the spring holder is inserted into the elongated attachment hole, the head is formed to be greater than a diameter of the elongated attachment hole, and the engagement portions are formed in a position separated from the head by a thickness of the inner helmet and have the same shape with the elongated attachment hole to pass through the circular insertion portion so as to be engaged with the inner helmet after rotating; and a shock absorbing spring that is fit to the other end of the spring holder to relieve the external shock while supporting the outer helmet and the inner helmet.

16. The bulletproof, shock-absorbing helmet according to claim 11, wherein the first shock absorbing means includes:

a spring holder that includes a penetrating hole formed in the inner helmet and one end inserted into the penetrating hole and receiving a nut screwed and fastened thereto; and a shock absorbing spring that is fit to the other end of the spring holder to absorb the external shock while maintaining the outer helmet and the inner helmet.

17. The bulletproof, shock-absorbing helmet according to claim 11, wherein the second shock absorbing means includes:

a rotational shaft coupling member in which screw threads are formed in an outer periphery and an inner periphery, wherein the rotational shaft coupling member receives a first nut screwed and fastened to the outer periphery so as to allow a top of the rotational shaft coupling member to be engaged on a top of the outer helmet through a penetrating hole of the outer helmet;

a space securing member in which an inner diameter is greater than an inner diameter of the rotational shaft coupling member, wherein an outer periphery of the space securing member receives a second nut screwed and fastened thereto so as to allow a bottom of the space securing member to be engaged in the inner helmet through a penetrating hole of the inner helmet corresponding to the rotational shaft coupling member;

a shock absorbing spring of which upper and lower ends are fixed to the first nut and the second nut, respectively; and a rotational shaft that is fastened to an inner periphery of the rotational shaft coupling member through a screw to secure a buffer space within the space securing member, and is rotatable while being engaged with a lower end of the space securing member by forming a top surface as a curved surface.

18. The bulletproof, shock-absorbing helmet according to claim 11, wherein a plurality of vent holes is formed in the inner helmet so as to ventilate external air introduced to or exhausted from the buffer space to the wearer head.

* * * * *